US008465195B1

(12) United States Patent
Boldt

(10) Patent No.: US 8,465,195 B1
(45) Date of Patent: Jun. 18, 2013

(54) DEVICE FOR MIXING A BOTTLE OF BABY FORMULA

(71) Applicant: Edward C. Boldt, Menomonee Falls, WI (US)

(72) Inventor: Edward C. Boldt, Menomonee Falls, WI (US)

( * ) Notice: Subject to any disclaimer, the term of this patent is extended or adjusted under 35 U.S.C. 154(b) by 0 days.

(21) Appl. No.: 13/735,240

(22) Filed: Jan. 7, 2013

Related U.S. Application Data

(60) Provisional application No. 61/609,997, filed on Mar. 13, 2012.

(51) Int. Cl.
*B01F 11/00* (2006.01)

(52) U.S. Cl.
USPC ..... 366/110; 366/211

(58) Field of Classification Search
USPC ..... 366/110–112, 114, 116, 208–219, 366/239
See application file for complete search history.

(56) References Cited

U.S. PATENT DOCUMENTS

| | | | | | |
|---|---|---|---|---|---|
| 1,085,450 | A * | 1/1914 | Lopez | 366/210 |
| 1,960,640 | A * | 5/1934 | Lajeunesse | 366/215 |
| 2,002,323 | A * | 5/1935 | Kurz | 366/211 |
| 2,034,902 | A * | 3/1936 | Heinze | 366/209 |
| 2,597,536 | A * | 5/1952 | Shields | 366/211 |
| 2,717,700 | A * | 9/1955 | Gruzensky et al. | 211/74 |
| 2,846,201 | A * | 8/1958 | Mermelstein | 366/110 |
| 2,946,273 | A * | 7/1960 | Hitzl | 366/211 |
| 3,128,082 | A * | 4/1964 | Cline | 366/210 |
| 3,301,534 | A * | 1/1967 | Orser | 366/210 |
| 3,331,588 | A * | 7/1967 | Nasser | 366/211 |
| 3,437,317 | A * | 4/1969 | Micin | 366/211 |
| 3,503,592 | A * | 3/1970 | Taylor et al. | 366/212 |
| 3,735,964 | A * | 5/1973 | Lorenzen | 366/211 |
| 3,788,611 | A * | 1/1974 | Barbini | 366/208 |
| 4,162,129 | A * | 7/1979 | Bartholemew, Jr. | 366/211 |
| 4,316,672 | A * | 2/1982 | Kerscher | 366/212 |
| 4,422,768 | A * | 12/1983 | Solomon | 366/110 |
| 4,763,570 | A * | 8/1988 | Bellanca | 99/348 |
| 5,050,996 | A * | 9/1991 | Allen | 366/211 |
| 6,745,664 | B2 * | 6/2004 | Kopkie | 91/49 |
| 7,604,392 | B2 * | 10/2009 | Brezinsky et al. | 366/211 |
| 7,645,065 | B2 * | 1/2010 | Bae | 366/111 |
| 7,810,989 | B2 * | 10/2010 | Little | 366/212 |
| 8,132,960 | B2 * | 3/2012 | Zhuang | 366/216 |
| 8,137,622 | B2 * | 3/2012 | Li et al. | 422/64 |
| 2002/0039327 | A1 * | 4/2002 | Kopkie | 366/211 |
| 2002/0110046 | A1 * | 8/2002 | Robertson | 366/110 |
| 2004/0218467 | A1 * | 11/2004 | Kopkie | 366/215 |
| 2007/0201301 | A1 * | 8/2007 | Klepinger | 366/110 |
| 2008/0232188 | A1 * | 9/2008 | Brezinsky et al. | 366/211 |
| 2009/0067281 | A1 * | 3/2009 | Little | 366/209 |
| 2013/0039145 | A1 * | 2/2013 | Pollaro et al. | 366/142 |

* cited by examiner

*Primary Examiner* — Charles E Cooley
(74) *Attorney, Agent, or Firm* — Donald J. Ersler

(57) ABSTRACT

A device for mixing a bottle of baby formula preferably includes a device housing, a motor, a drive linkage and a bottle retainer. The drive linkage includes an eccentric drive disk, a drive arm, a pivoting arm and a pivot mounting base. The pivot mounting base includes a bottle drive shaft. The eccentric drive disk pivots the bottle drive shaft through the drive arm and the pivoting arm. The pivot mounting base is secured to the device housing. The bottle retainer preferably includes a bottle housing, a locking door and a bottle drive shaft boss. The locking door is pivotally retained on an open end of the bottle housing. The bottle drive shaft is retained in the bottle drive shaft boss. The motor rotates the eccentric drive disk, which causes the bottle to shake back and forth. A second embodiment replaces the device housing with a support member.

19 Claims, 8 Drawing Sheets

DEVICE FOR MIXING A BOTTLE OF BABY FORMULA

CROSS-REFERENCES TO RELATED APPLICATIONS

This is a utility patent application taking priority from provisional application No. 61/609,997 filed on Mar. 13, 2012.

BACKGROUND OF THE INVENTION

1. Field of the Invention The present invention relates generally to mixing devices and more specifically to a device for mixing a bottle of baby formula, which eliminates the need to manually mix the bottle of baby formula.

2. Discussion of the Prior Art

U.S. Pat. No. 3,301,534 to Orser discloses a paint shaker machine. U.S. Pat. No. 5,050,996 to Allen discloses a paint shaker apparatus powered by a pneumatic sanding tool.

Accordingly, there is a clearly felt need in the art for a device for mixing a bottle of baby formula, which eliminates the need to manually mix a bottle of baby formula and prevents repetitive wrist injury from shaking the bottle of baby formula.

SUMMARY OF THE INVENTION

The present invention provides a device for mixing a bottle of baby formula, which eliminates the need to manually mix a bottle of baby formula. The device for mixing a bottle of baby formula (bottle mixing device) preferably includes a device housing, a motor, a drive linkage and a bottle retainer. The device housing includes a top platform and at least one side wall extending downward from a perimeter of the top platform. The motor is preferably mounted to a bottom of the top platform. The drive linkage preferably includes an eccentric drive disk, a drive arm, a pivoting arm and a pivot mounting base. The eccentric drive disk is secured to a drive shaft of the motor. One end of the drive arm is pivotally retained on the eccentric drive disk and the other end is secured to one end of a pivot arm. The other end of the pivot arm is inserted into and secured to one end of a bottle drive shaft of the pivot mounting base. The pivot mounting base is secured to a bottom of the top platform.

The bottle retainer preferably includes a bottle housing, a locking door and a bottle drive shaft boss. The locking door is pivotally attached to an open end of the bottle housing. The bottle drive shaft boss extends from a bottom of the bottle housing. The bottle drive shaft boss includes a shaft bore, which is sized to receive the other end of the bottle drive shaft. In use, an un-mixed bottle of baby formula is inserted into the bottle housing. The locking door is secured to the bottle housing. The motor is powered by depressing an electrical switch. The motor rotates the eccentric drive disk, which causes the drive arm to pivot the bottle drive shaft through the pivoting arm. The bottle drive shaft causes a bottle in the retainer to pivot back and forth in a horizontal plane.

A second embodiment of the bottle mixing device replaces the device housing with a support member. The support member preferably includes a mounting plate, at least three legs and a device cage. The bottle retainer is pivotally retained by the mounting plate. The motor and the pivot mounting base are mounted to a bottom of the mounting plate. The at least three legs extend from the mounting plate. The device cage preferably covers the motor, drive linkage and pivot mounting base.

Accordingly, it is an object of the present invention to provide a bottle mixing device, which eliminates the need to manually mix a bottle of baby formula and prevents repetitive wrist injury from shaking the bottle of baby formula.

These and additional objects, advantages, features and benefits of the present invention will become apparent from the following specification.

DETAILED DESCRIPTION OF THE PREFERRED EMBODIMENTS

Figure 1:
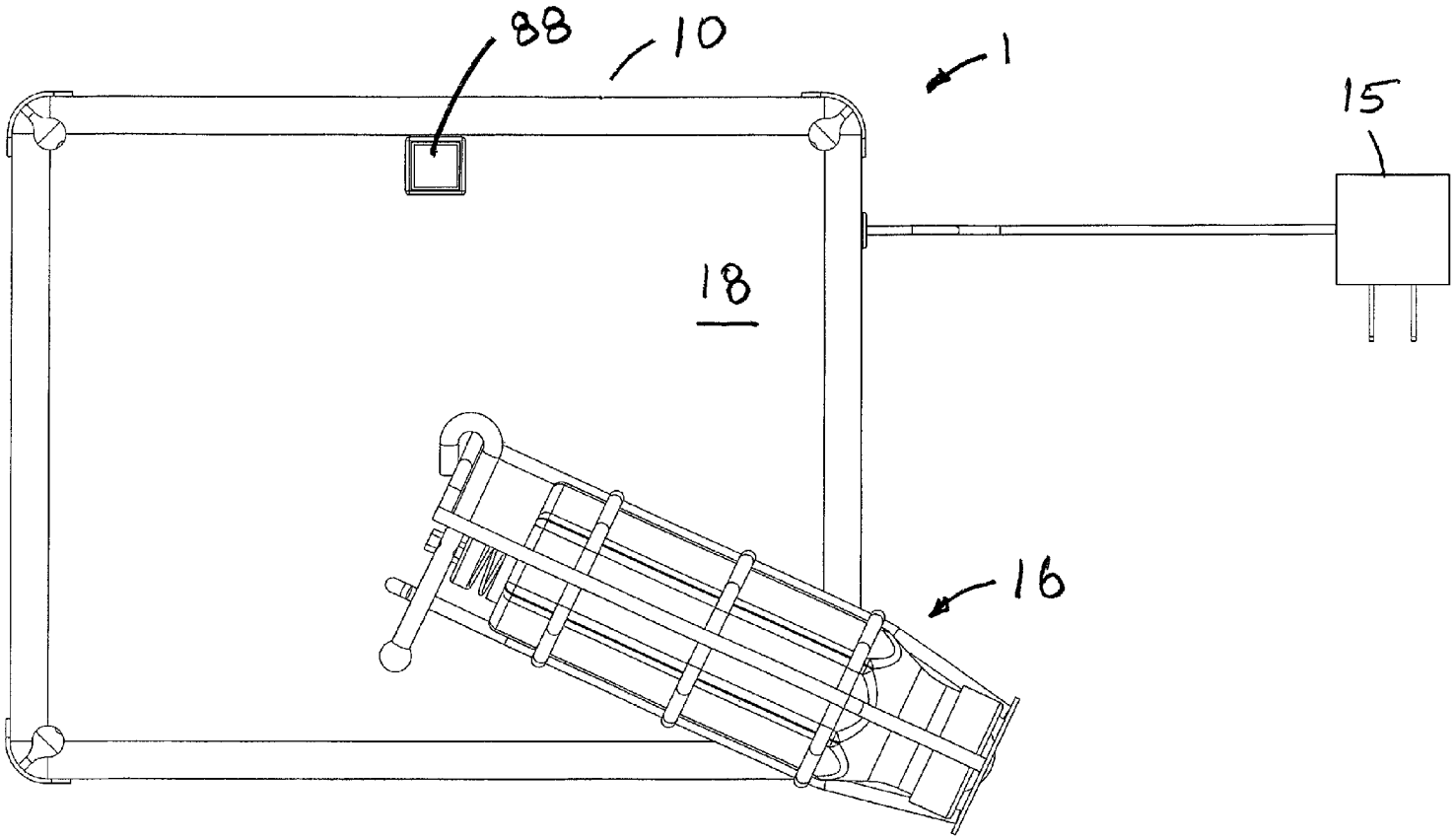
FIG. 1 is a top view of a bottle mixing device in accordance with the present invention.
Figure 2:
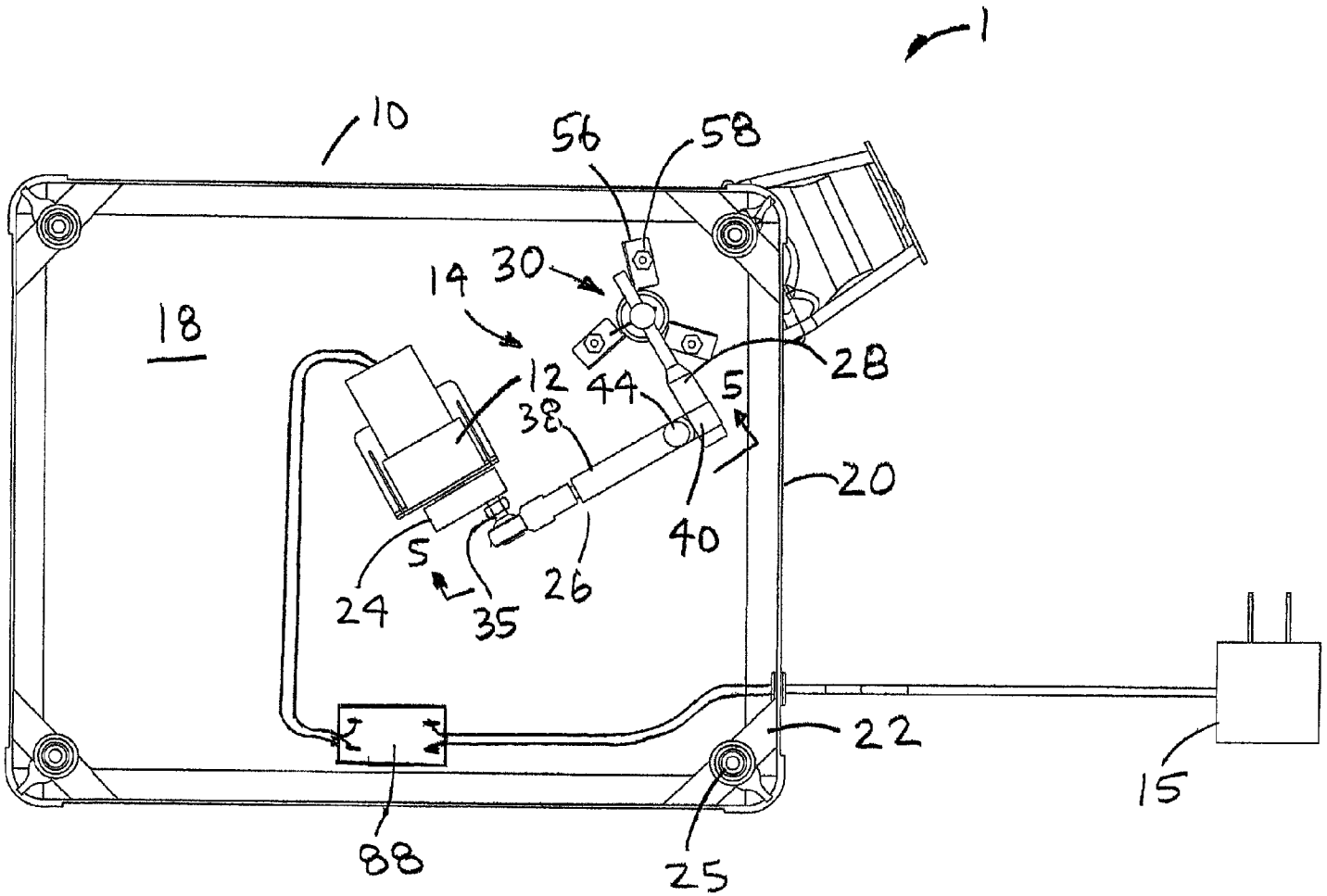
FIG. 2 is a bottom view of a bottle mixing device in accordance with the present invention.
Figure 3:
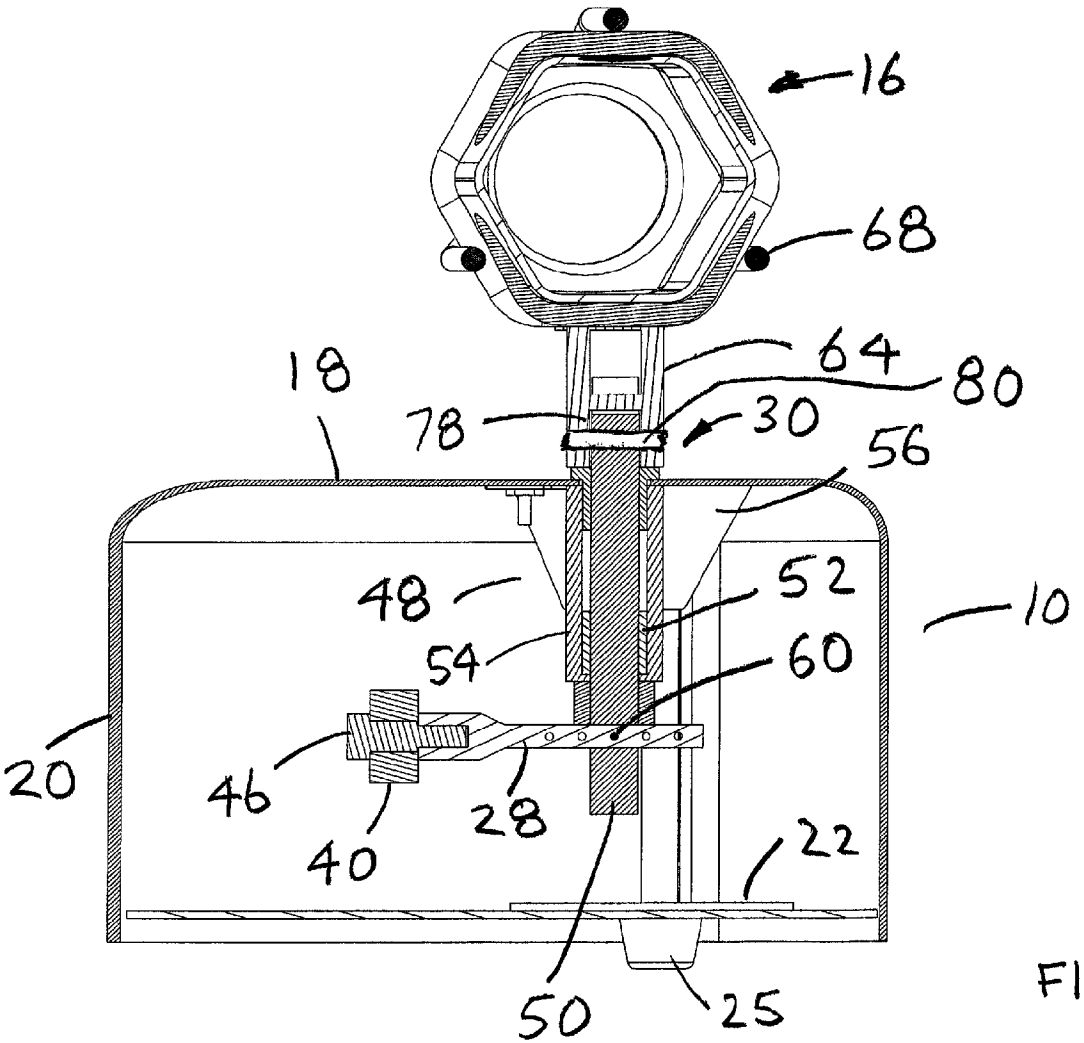
FIG. 3 is a cross sectional view of a bottle mixing device in accordance with the present invention.

With reference now to the drawings, and particularly to FIG. 1, there is shown a top view of a bottle mixing device 1. With reference to FIGS. 2-5, the bottle mixing device 1 preferably includes a device housing 10, a motor 12, a drive linkage 14 and a bottle retainer 16. The device housing 10 preferably includes a top platform 18 and at least one side wall 20. The at least one side wall 20 extends downward from and around a perimeter of the top platform 18. A foot strap 22 may be attached to a bottom of the at least one side wall 20 for securement of a rubber foot 25 or the like. The motor 12 is preferably powered by electricity, but other rotation sources may also be used. The motor 12 is preferably mounted to a bottom of the top platform 18. The motor 12 is preferably driven by an AC to DC converter 15. The motor 12 could be any suitable device for rotating a drive shaft.

The drive linkage 14 preferably includes an eccentric drive disk 24, a drive arm 26, a pivoting arm 28 and a pivot mounting base 30. The eccentric drive disk 24 includes a shaft boss 34 and a drive pin 35. The shaft boss 34 is secured to a drive shaft 32 of the motor 12 with a set screw 36 or the like. The drive arm 26 includes a drive leg 38 and a pivot leg extension 40. A spherical bearing 42 is rotatably retained in one end of the drive leg 38. The other end of the drive leg 38 is pivotally engaged with one end of the pivot leg extension 40 utilizing a fastener 44. The other end of the pivot leg extension 40 is attached to one end of the pivot arm 28 utilizing a fastener 46.

The pivot mounting base 30 preferably includes a shaft housing 48, a bottle drive shaft 50 and at least one shaft bearing 52. The shaft housing 48 includes a pivot tube 54 and at least one attachment flange 56. The at least one attachment flange 56 extends from an end of the pivot tube 54. At least one fastener 58 is used to attach the mounting base 30 to an inside surface of the top platform 18. The at least one shaft bearing 52 is retained in an inner diameter of the pivot tube 54. The bottle drive shaft 50 is inserted through the at least one shaft bearing 52. The other end of the pivot arm 28 is inserted into the bottle drive shaft 50. A retention pin 60 is preferably inserted through the other end of the pivot arm 28 and one end of the bottle drive shaft 50 to secure the pivot arm 28 to the bottle drive shaft 50.

Figure 4:
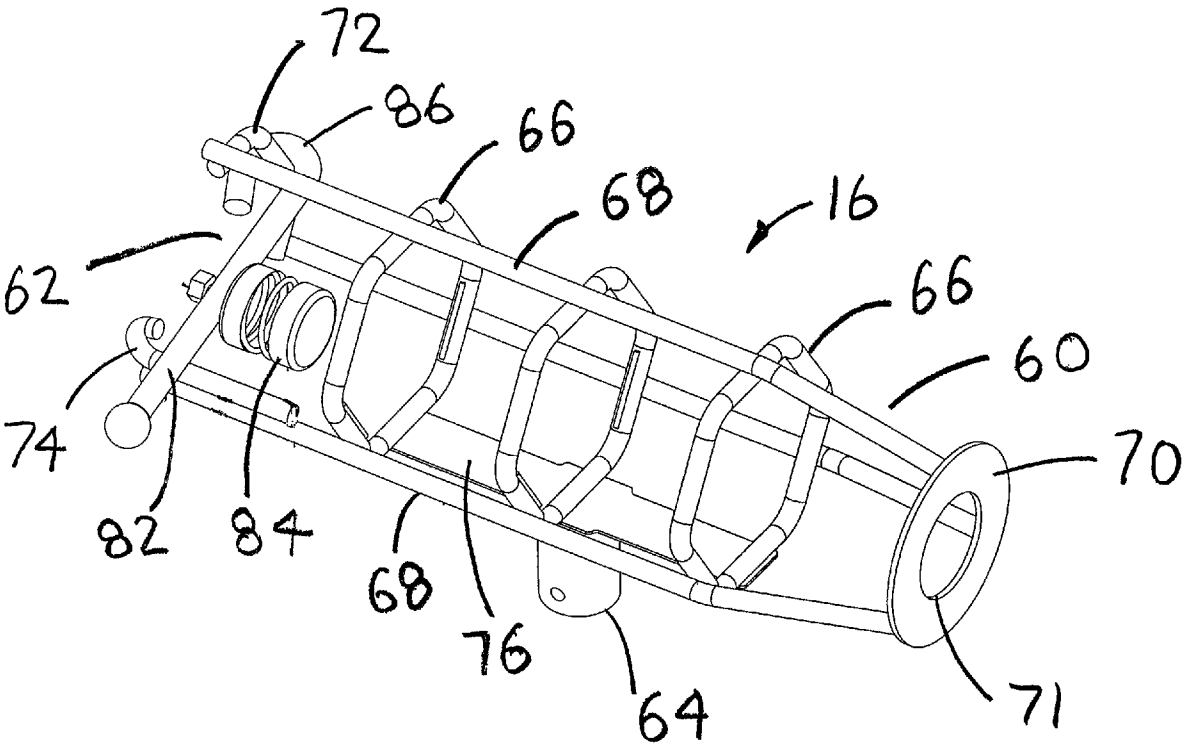
FIG. 4 is a perspective view of a bottle retainer of a bottle mixing device in accordance with the present invention.
Figure 5:
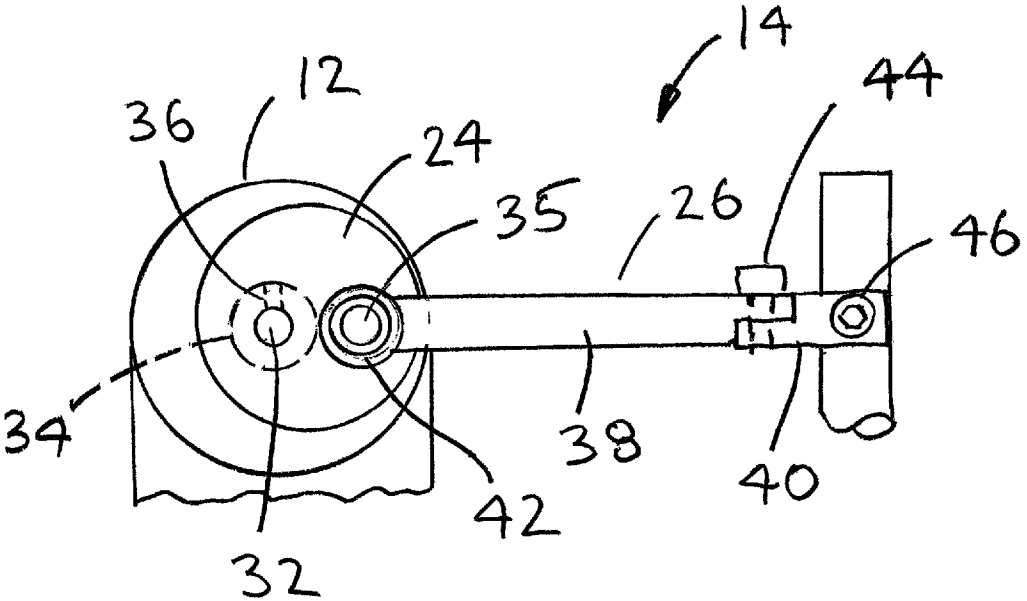
FIG. 5 is a front view of a motor and a portion of a drive linkage of a bottle mixing device in accordance with the present invention.

The bottle retainer 16 preferably includes a bottle housing 60, a locking door 62 and a bottle drive shaft boss 64. The bottle housing 60 preferably includes a plurality of retention rings 66, at least three retention rods 68 and an end member 70 thereby defining a cage-like housing member 60 defining a longitudinal axis as seen in FIG. 4. The at least three retention rods 68 are attached around a perimeter of the plurality of retention rings 66. The end member 70 is attached to one end of the at least three retention rods 68 to form a closed end of the bottle housing 62. The end member 70 includes a nipple clearance hole 71. However, other designs of bottle housings may also be used. A door pivot rod 72 is attached to the other end of at least one of the at least three retention rods 68. A door latch 74 is attached to at least one of the at least three retention rods 68, opposite the door pivot rod 72. A boss plate 76 is attached to a bottom of the plurality of retention rings 66. The bottle drive shaft boss 64 is attached to the boss plate 76. The bottle drive shaft boss 64 includes a bore 78, which is sized to receive the other end of the bottle drive shaft 50. A retention pin 80 is preferably inserted through the bottle drive shaft boss 64 and the bottle drive shaft 50 to retain the bottle drive shaft 50 in the bottle drive shaft boss 64.

The locking door 62 preferably includes a pivot rod 82 and a spring loaded plunger 84. One end of the pivot rod 82 includes a hooked end 86 for hooking around the door pivot rod 72. The other end of the pivot rod 82 is retained by the door latch 74. The spring loaded plunger 84 is retained in substantially a center of the plurality of retention rings 66. The spring loaded plunger 84 forces a cap end of a bottle of baby formula (not shown) against the end member 70 to prevent axial motion when the bottle is shook.

The bottle drive shaft 50 extends from a bottom of the bottle retainer 16 wherein the bottle drive shaft 50 is positioned about substantially a middle region of the bottle retainer 16. The bottle drive shaft 50 defines an axis that is generally perpendicular to the longitudinal axis of the bottle retainer 16.

In use, an un-mixed bottle of baby formula is inserted into the bottle housing 60. The locking door 62 is secured with the door latch 74. The motor 12 is powered by depressing an electrical switch 88. The electrical switch 88 is electrically connected to the motor 12 and retained in the device housing 10. The motor 12 rotates the eccentric drive disk 24, which causes the drive arm 26 to pivot the bottle drive shaft 50 through the pivoting arm 28. The bottle drive shaft 50 causes the bottle in the bottle retainer 16 to pivot back and forth in a horizontal plane and thus shake the contents in the bottle.

Figure 6:
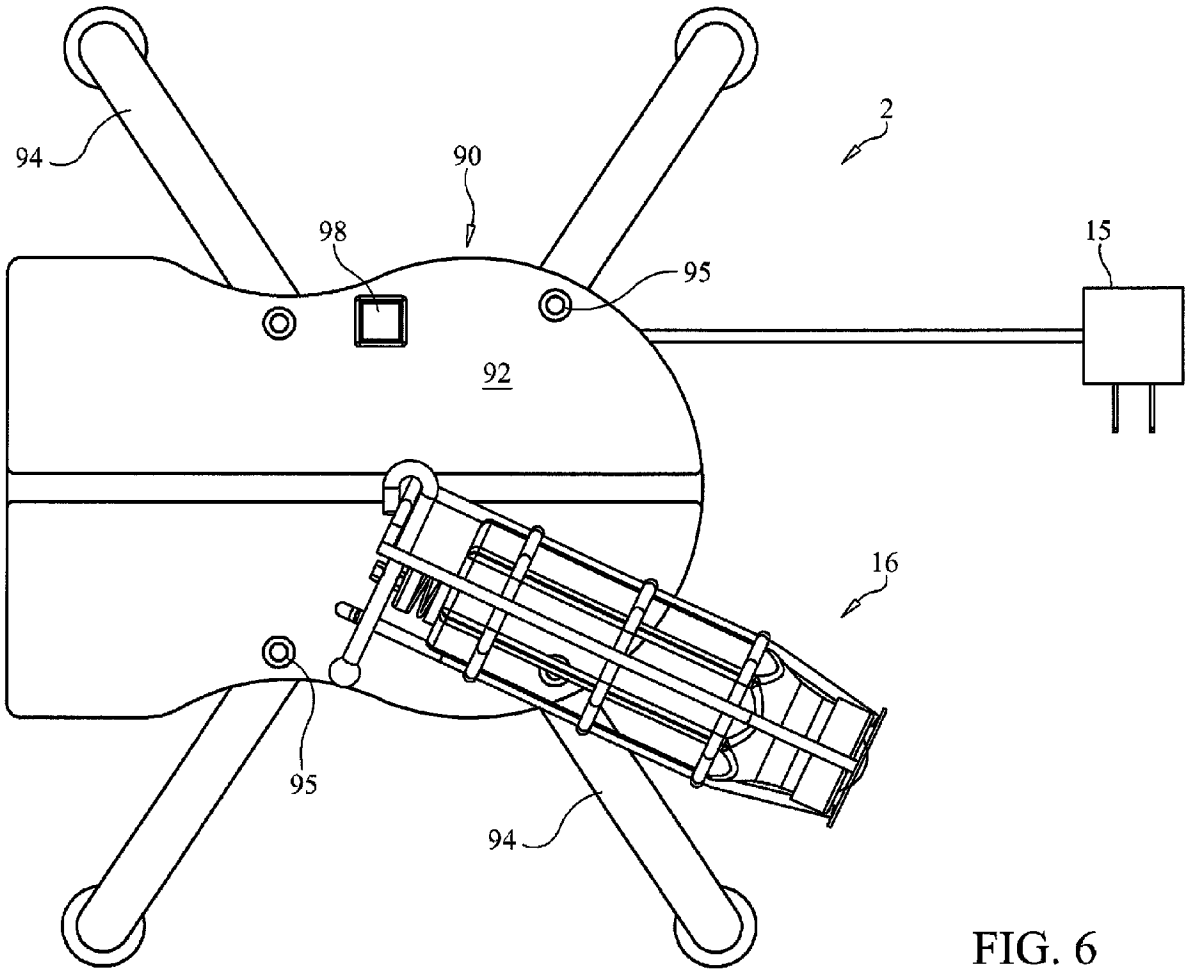
FIG. 6 is a top view of a second embodiment of a bottle mixing device in accordance with the present invention.
Figure 7:
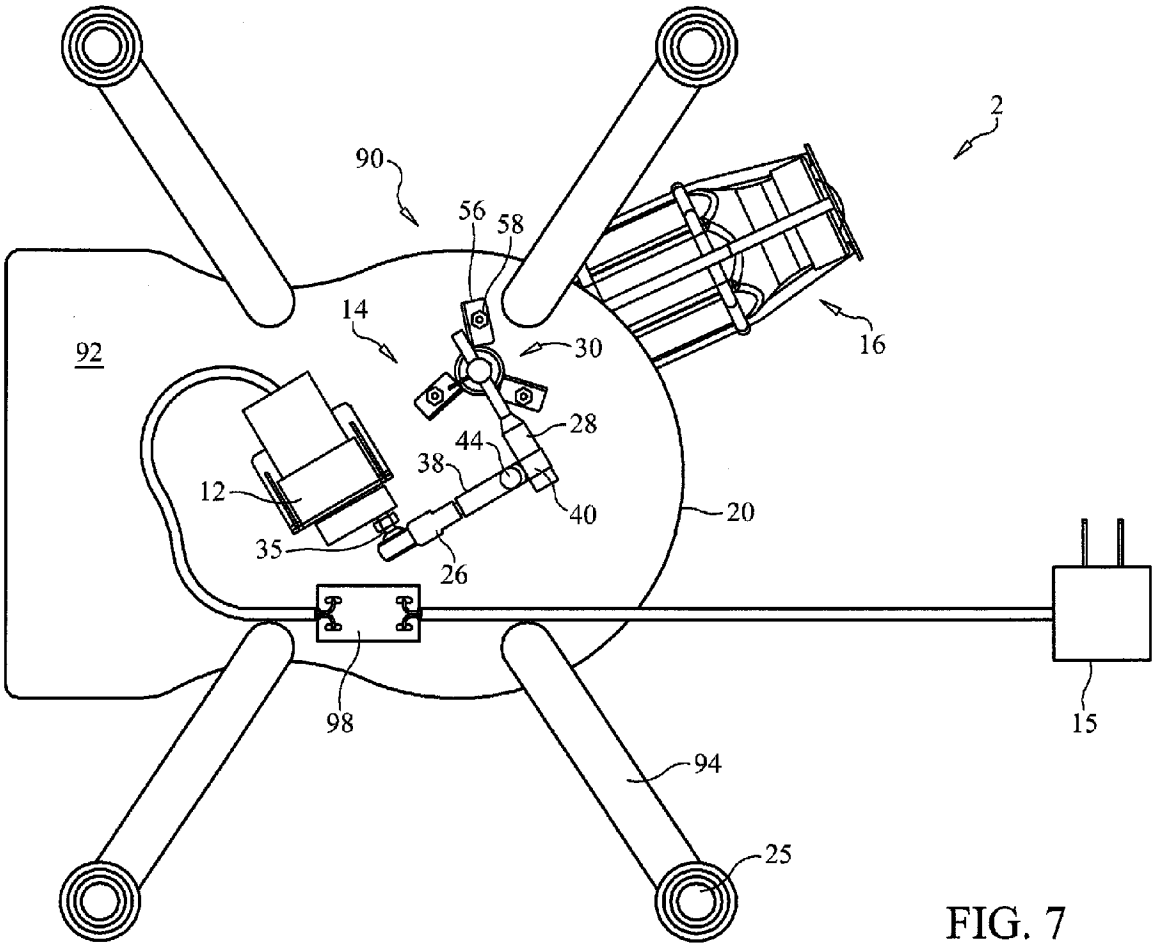
FIG. 7 is a bottom view of a second embodiment of a bottle mixing device with a device cage removed in accordance with the present invention.
Figure 8:
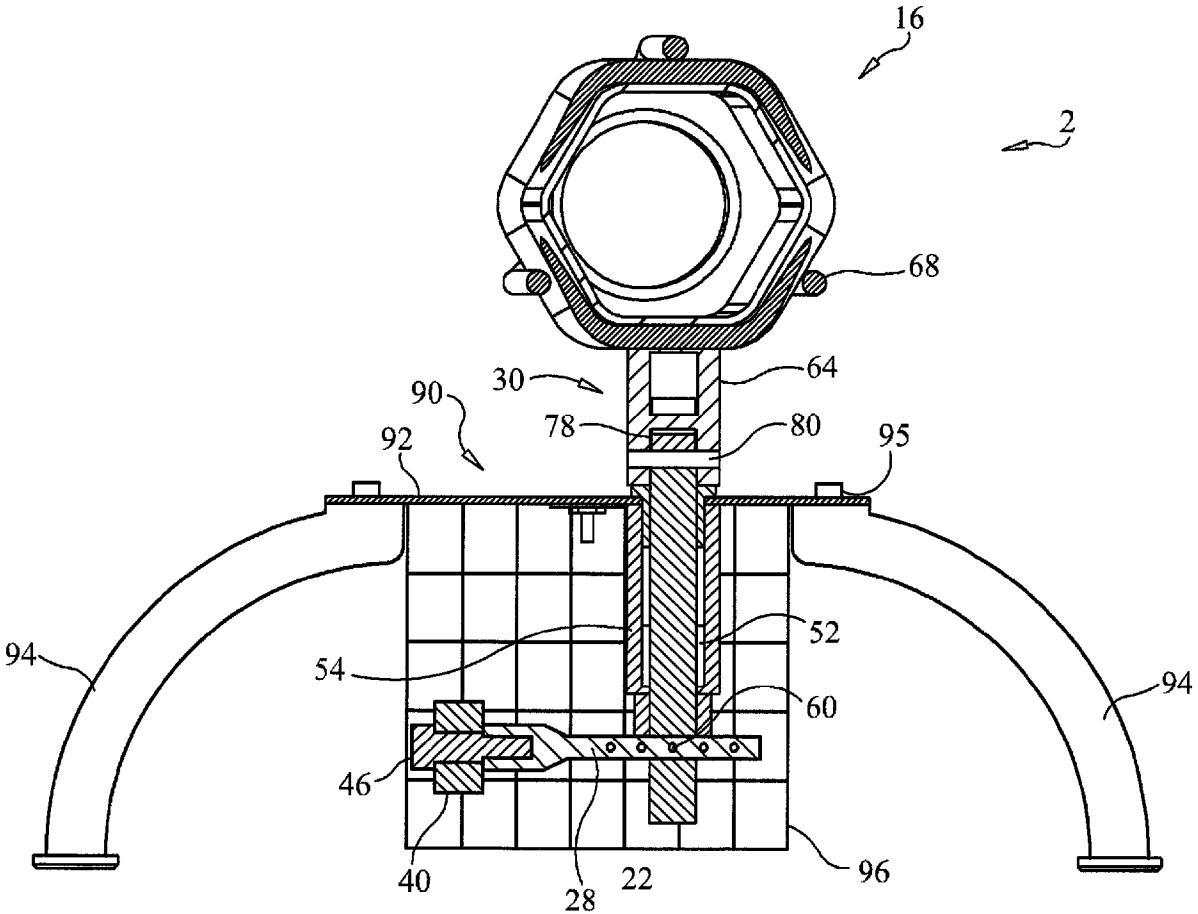
FIG. 8 is a side view of a second embodiment of a bottle mixing device in accordance with the present invention.

With reference to FIGS. 6-8, a second embodiment of the bottle mixing device 2 replaces the device housing 10 with a support member 90. The support member 90 preferably includes a mounting plate 92, at least three legs 94 and a device cage 96. The bottle retainer 16 is pivotally retained by the mounting plate 92. The motor 12 and the pivot mounting base 30 of the bottle retainer 16 are attached to a bottom of the mounting plate 92. The at least three legs 94 extend from the mounting plate 92 and the at least three legs 94 are attached to the mounting plate 92 with any suitable device, such as fasteners 95. The device cage 96 covers the motor 12, drive linkage 14 and the pivot mounting base 30. The motor 12 is powered by depressing an electrical switch 98. The electrical switch 98 is electrically connected between the motor 12 and the AC to DC converter 15. The electrical switch 98 is preferably retained on a top of the mounting plate 92.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A device for mixing contents of a bottle comprising:

a device support;

means for rotating a drive shaft, said means for rotating said drive shaft is retained by said device support;

an eccentric drive disk is secured to said drive shaft;

a bottle retainer defining a longitudinal axis, said bottle retainer including rods and rings defining a cage-like housing member for removably retaining a bottle in substantially a horizontal plane;

a bottle drive shaft extends from a bottom of said bottle retainer, said bottle drive shaft is positioned about substantially a middle region of said bottle retainer, said bottle drive shaft defining an axis that is generally perpendicular to said axis of the said bottle retainer, said bottle drive shaft is pivotally retained by said device support; and a drive linkage having one end pivotally connected to said eccentric drive disk and the other end pivotally connected to said bottle drive shaft, wherein rotation of said drive shaft causing said bottle retainer to pivot back and forth in the horizontal plane.

2. The device for mixing contents of a bottle of claim 1, further comprising:

said drive linkage includes a drive arm and a pivoting arm, one end of said drive arm is pivotally connected to said eccentric drive disk, the other end of said drive arm is pivotally connected to one end of said pivoting arm, the other end of said pivoting arm is connected to said bottle drive shaft.

3. The device for mixing contents of a bottle of claim 2, further comprising:

a spherical bearing is retained in said one end of said drive arm.

4. The device for mixing contents of a bottle of claim 1, further comprising:

said bottle retainer includes a locking door, said locking door is pivotally retained on an open end of said bottle housing, an end of said bottle drive shaft is retained on the bottom of said bottle housing.

5. The device for mixing contents of a bottle of claim 4, further comprising:

said locking door includes a spring loaded plunger for forcing a cap end of a bottle against a closed end of said bottle housing.

6. The device for mixing contents of a bottle of claim 1 wherein:

said device support is a device housing, said device housing includes a top platform and at least one side wall extending downward from and around a perimeter of said top platform.

7. The device for mixing contents of a bottle of claim 1 wherein:

said device support is a support member, said support member includes a mounting plate, at least three legs and a device cage, said at least three legs extend from said mounting plate, said device cage is retained on a bottom of said mounting plate to cover said rotating means and said drive linkage.

8. A device for mixing contents of a bottle comprising:

a device support;

an electric motor includes a drive shaft, said electric motor is retained by said device support;

an eccentric drive disk is secured to said drive shaft;

a bottle retainer defining a longitudinal axis, said bottle retainer including rods and rings defining a cage-like housing member for removably retaining a bottle in substantially a horizontal plane;

a bottle drive shaft extends from a bottom of said bottle retainer, said bottle drive shaft is positioned about substantially a middle region of said bottle retainer, said bottle drive shaft defining an axis that is generally perpendicular to said axis of the said bottle retainer, said bottle drive shaft is pivotally retained by said device support; and a drive linkage having one end pivotally connected to said eccentric drive disk and the other end pivotally connected to said bottle drive shaft, wherein rotation of said drive shaft causing said bottle retainer to pivot back and forth in the horizontal plane.

9. The device for mixing contents of a bottle of claim 8, further comprising:

said drive linkage includes a drive arm and a pivoting arm, one end of said drive arm is pivotally connected to said eccentric drive disk, the other end of said drive arm is pivotally connected to one end of said pivoting arm, the other end of said pivoting arm is connected to said bottle drive shaft.

10. The device for mixing contents of a bottle of claim 9, further comprising:

a spherical bearing is retained in said one end of said drive arm.

11. The device for mixing contents of a bottle of claim 8, further comprising:

said bottle retainer includes a locking door, said locking door is pivotally-retained on an open end of said bottle housing, an end of said bottle drive shaft is retained on the bottom of said bottle housing.

12. The device for mixing contents of a bottle of claim 11, further comprising:

said locking door includes a spring loaded plunger for forcing a cap end of a bottle against a closed end of said bottle housing.

13. The device for mixing contents of a bottle of claim 8 wherein:

said device support is a device housing, said device housing includes a top platform and at least one side wall extending downward from and around a perimeter of said top platform.

14. The device for mixing contents of a bottle of claim 8 wherein:

said device support is a support member, said support member includes a mounting plate, at least three legs and a device cage, said at least three legs extend from said mounting plate, said device cage is retained on a bottom of said mounting plate to cover said motor and said drive linkage.

15. A device for mixing contents of a bottle comprising:

means for rotating a drive shaft, said means for rotating said drive shaft is retained by said device support;

an eccentric drive disk is secured to said drive shaft; a bottle retainer for removably retaining a bottle;

a bottle drive shaft extends from said bottle retainer, said bottle drive shaft is pivotally retained by device support; and a drive linkage having one end pivotally connected to said eccentric drive disk and the other end pivotally connected to said bottle drive shaft, wherein rotation of said drive shaft causing said bottle retainer to pivot back and forth;

a device support including a support member, said support member includes a mounting plate, at least three legs and a device cage, said at least three legs extend from said mounting plate, said device cage is retained on a bottom of said mounting plate to cover said rotating means and said drive linkage.

16. The device for mixing contents of a bottle of claim 15, further comprising:

said drive linkage includes a drive arm and a pivoting arm, one end of said drive arm is pivotally connected to said eccentric drive disk, the other end of said drive arm is pivotally connected to one end of said pivoting arm, the other end of said pivoting arm is connected to said bottle drive shaft.

17. The device for mixing contents of a bottle of claim 16, further comprising:

a spherical bearing is retained in said one end of said drive arm.

18. The device for mixing contents of a bottle of claim 15, further comprising:

said bottle retainer includes a bottle housing and a locking door, said locking door is pivotally retained on an open end of said bottle housing, an end of said bottle drive shaft is retained on a bottom of said bottle housing.

19. The device for mixing contents of a bottle of claim 18, further comprising:

said locking door includes a spring loaded plunger for forcing a cap end of a bottle against a closed end of said bottle housing.

* * * * *